US009412211B2

(12) United States Patent
Dato

(10) Patent No.: US 9,412,211 B2
(45) Date of Patent: Aug. 9, 2016

(54) SYSTEM AND METHOD FOR ON-VEHICLE DYNAMIC ACCIDENT RECREATION USING ACCIDENT DATA RECORDING

(71) Applicant: Toyota Motor Engineering & Manufacturing North America, Inc., Erlanger, KY (US)

(72) Inventor: Gregory G. Dato, Agoura Hills, CA (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 149 days.

(21) Appl. No.: 14/225,269

(22) Filed: Mar. 25, 2014

(65) Prior Publication Data

US 2015/0279127 A1 Oct. 1, 2015

(51) Int. Cl.
*G07C 5/08* (2006.01)

(52) U.S. Cl.
CPC ..... *G07C 5/085* (2013.01)

(58) Field of Classification Search
CPC ..... G07C 5/085; G07C 5/08; G07C 5/0808; G07C 5/0816; G07C 5/0825; G07C 5/0833; G07C 5/0841; G07C 5/0858; G07C 5/0866; G07C 5/0875; G07C 5/0883
See application file for complete search history.

(56) References Cited

U.S. PATENT DOCUMENTS 4,638,289 A 1/1987 Zottnik
5,338,206 A * 8/1994 Hupfer ..... G01M 17/0078 318/587
5,446,659 A * 8/1995 Yamawaki ..... G07C 5/085 340/438
5,623,094 A 4/1997 Song et al.
6,185,490 B1 2/2001 Ferguson
6,246,933 B1 6/2001 Bague
7,359,821 B1 4/2008 Smith et al.
7,739,087 B2 6/2010 Qiu
7,783,461 B2 8/2010 Dato (Continued)

FOREIGN PATENT DOCUMENTS

EP 1068504 7/2003

OTHER PUBLICATIONS

"Delphi's Test Sled Facility is One-of-A-Kind Safety Testing Service for Motor Sports Industry"; Delphi Corporation; 2 pages; May 21, 2003.

(Continued)

*Primary Examiner* — Mussa A Shaawat
*Assistant Examiner* — Kyung Kim
(74) *Attorney, Agent, or Firm* — Snell & Wilmer LLP

(57) ABSTRACT

A system and a method for recreating an operation of a crashed vehicle during and/or before the accident. An accident data recorder collects vehicle operation data related to the operation of the crashed vehicle prior to and/or during the accident. A processor may analyze the prior vehicle operation data that may include prior acceleration input data, prior braking input data, and/or prior steering input data and may output vehicle control data to at least one electronic controller based on the prior vehicle operation data. The at least one electronic controller automatically operates the test vehicle on a test surface to recreate an operation of the crashed vehicle during and/or before the accident. At least one electronic controller unit automatically and accurately recreates a response of the crashed vehicle to the prior acceleration input, the prior steering input, and the prior braking input.

20 Claims, 6 Drawing Sheets

(56) References Cited

U.S. PATENT DOCUMENTS

| | | | | |
|---|---|---|---|---|
| 8,379,924 | B2 | 2/2013 | Schaufler | |
| 8,396,655 | B2 | 3/2013 | Breuer et al. | |
| 2006/0212195 | A1 | 9/2006 | Veith et al. | |
| 2011/0192240 | A1 * | 8/2011 | Kruse ..... | G01M 17/0078 73/865.3 |
| 2011/0295446 | A1 | 12/2011 | Basir et al. | |
| 2013/0061652 | A1 | 3/2013 | Wittmann et al. | |

OTHER PUBLICATIONS

Fildes et al. "Quality Criteria for the Safety Assessment of Cars Based on Real-World Crashes"; CEA Insurers of Europe; 51 pages; Nov. 2005.

* cited by examiner

SYSTEM AND METHOD FOR ON-VEHICLE DYNAMIC ACCIDENT RECREATION USING ACCIDENT DATA RECORDING

BACKGROUND

1. Field

The present invention relates to systems and methods for accident recreation using accident data recording.

2. Description of the Related Art

Vehicle manufacturers and consumers have been interested in gaining an accurate and comprehensive understanding of causes of a given vehicle accident. Such accurate and comprehensive understanding would improve automobile safety because accident recreation can suggest, for example, whether and how a device malfunctioned and whether the malfunctioning or a driver error or other external factors (besides the vehicle) caused the accident. Furthermore, an accurate and comprehensive understanding of a given vehicle accident would prevent or significantly decrease litigation costs and efforts over identifying the contributing factors or causes of the accident.

Accident Data Records (ADRs) or Event Data Recorders (EDRs) have been utilized in vehicles for collecting data at the time of and/or before an accident. For example, accident recreation can be performed by manual operation of a test vehicle that is similar in make and model to the crashed vehicle. For example, an experienced test driver may attempt to manually operate an input device of the test vehicle as indicated by data recorded in an ADR. However, manual operation based on the data recorded in the ADR may be susceptible to inaccuracies in recreating the accident.

Thus, there is a need for a method and a system that would more reliably and more accurately recreate an accident using data recorder in an ADR.

SUMMARY

In one embodiment, the present invention relates to a method and a system for recreating an operation of a crashed vehicle during and/or before the accident. An accident data recorder (ADR) collects vehicle operation data related to the operation of the crashed vehicle prior to and/or during the accident. A processor may analyze the prior vehicle operation data that may include prior acceleration input data, prior braking input data, and/or prior steering input data and convert the prior vehicle operation data to vehicle control data or signal outputted to at least one electronic controller. At least one electronic controller operates the test vehicle on a test surface to recreate an operation of the crashed vehicle during and/or before the accident. The at least one electronic controller unit automatically and accurately recreates a response of the crashed vehicle to the prior acceleration input, the prior steering input, and the prior braking input can be automatically and accurately recreated.

In one embodiment, a method for recreating a prior operation of a crashed vehicle before or at the time of an accident is utilized. The method includes performing the following steps: retrieving, from a memory of an accident data recorder, a prior vehicle operation data corresponding to the prior operation of the crashed vehicle before or at the time of the accident, the prior vehicle operation data including at least one of a prior steering input data or a prior braking input data; analyzing, using a processor connected to the accident data recorder, the prior vehicle operation data; providing at least one electronic controller configured to control a test operation of a test vehicle that is similar in make and model to the crashed vehicle; outputting, using the processor, a vehicle control data or signal to the at least one electronic controller based on the analyzed prior vehicle operation data; and automatically operating, using the at least one electronic controller, the test vehicle based on the vehicle control data or signal in order to recreate the prior operation of the crashed vehicle in response to the at least one of the prior steering input data or the prior braking input data.

In one embodiment, a method for recreating a prior operation of a crashed vehicle before or at the time of an accident is utilized, and the method includes performing the following steps: retrieving, from a memory of an accident data recorder, a prior vehicle operation data corresponding to the prior operation of the crashed vehicle before or at the time of the accident, the prior vehicle operation data including a prior acceleration input data detected by an acceleration input sensor during before or at the time of the accident, a prior steering input data detected by a steering input sensor before or at the time of the accident, and a prior braking input data detected by a braking input sensor before or at the time of the accident; analyzing, using a processor connected to the accident data recorder, the prior steering input data, the prior braking input data, and the prior acceleration input data; providing at least one electronic controller configured to control a test operation of a test vehicle that is similar in make and model to the crashed vehicle; outputting, using the processor, a vehicle control data or signal to the at least one electronic controller based on the analyzed prior vehicle operation data, the vehicle control data or signal including an acceleration control data or signal being based on the prior acceleration input data, a steering control data or signal being based on the prior steering input data, and a braking control data or signal being based on the prior braking input data; and automatically operating, using the at least one electronic controller, the test vehicle based on the vehicle control data or signal in order to recreate the prior operation of the crashed vehicle or a response of the crashed vehicle to the prior acceleration input data, the prior steering input data, and the prior braking input data.

In one embodiment, a system is utilized for recreating a prior operation of a crashed vehicle before or at the time of an accident. The system may include an accident data recorder having a memory for storing a prior vehicle operation data corresponding to the prior operation before or at the time of the accident, the prior vehicle operation data including at least one of prior steering input data or prior braking input data. The system may also include a processor connected to the accident data recorder and configured to: retrieve the prior vehicle operation data, analyze the prior vehicle operation data, and output a vehicle control data or signal based on the analyzed prior vehicle operation data. The system may also include at least one electronic controller configured to receive the vehicle control data or signal, and operate the test vehicle based on the vehicle control data or signal in order to recreate the prior operation of the crashed vehicle in response to the at least one of the prior steering input data or the prior braking input data.

BRIEF DESCRIPTION OF THE DRAWINGS

The features, obstacles, and advantages of the present invention will become more apparent from the detailed description set forth below when taken in conjunction with the drawings, wherein.

DETAILED DESCRIPTION

Apparatus, systems and methods that implement the embodiments of the various features of the present invention will now be described with reference to the drawings. The drawings and the associated descriptions are provided to illustrate some embodiments of the present invention and not to limit the scope of the present invention. Throughout the drawings, reference numbers are re-used to indicate correspondence between referenced elements.

In an embodiment, a system and a method are provided for recreating the exact performance of a vehicle before and/or at the time of a crash based on accident data recorder data. During operation of a vehicle, an accident data recorder (ADR) collects data related to the operation of the vehicle. Prior vehicle operation data includes any data recorded by the ADR regarding any operation of the vehicle that are helpful for analyzing and/or recreating the accident. For example, how fast the vehicle was travelling, how much the accelerator pedal was depressed, how much the brake pedal was depressed, how much and what direction the steering wheel was turned prior to the crash, etc. The prior vehicle operation data can then be imported into a dynamic vehicle controller of a test vehicle with similar make and model vehicle for a real-time demonstration. The ADR data recovered from the crashed vehicle is then used as inputs to at least one electronic controller for real-time recreation of the crashed vehicle's operation before the accident, for example, on a test track or a skid pad.

Figure 1:
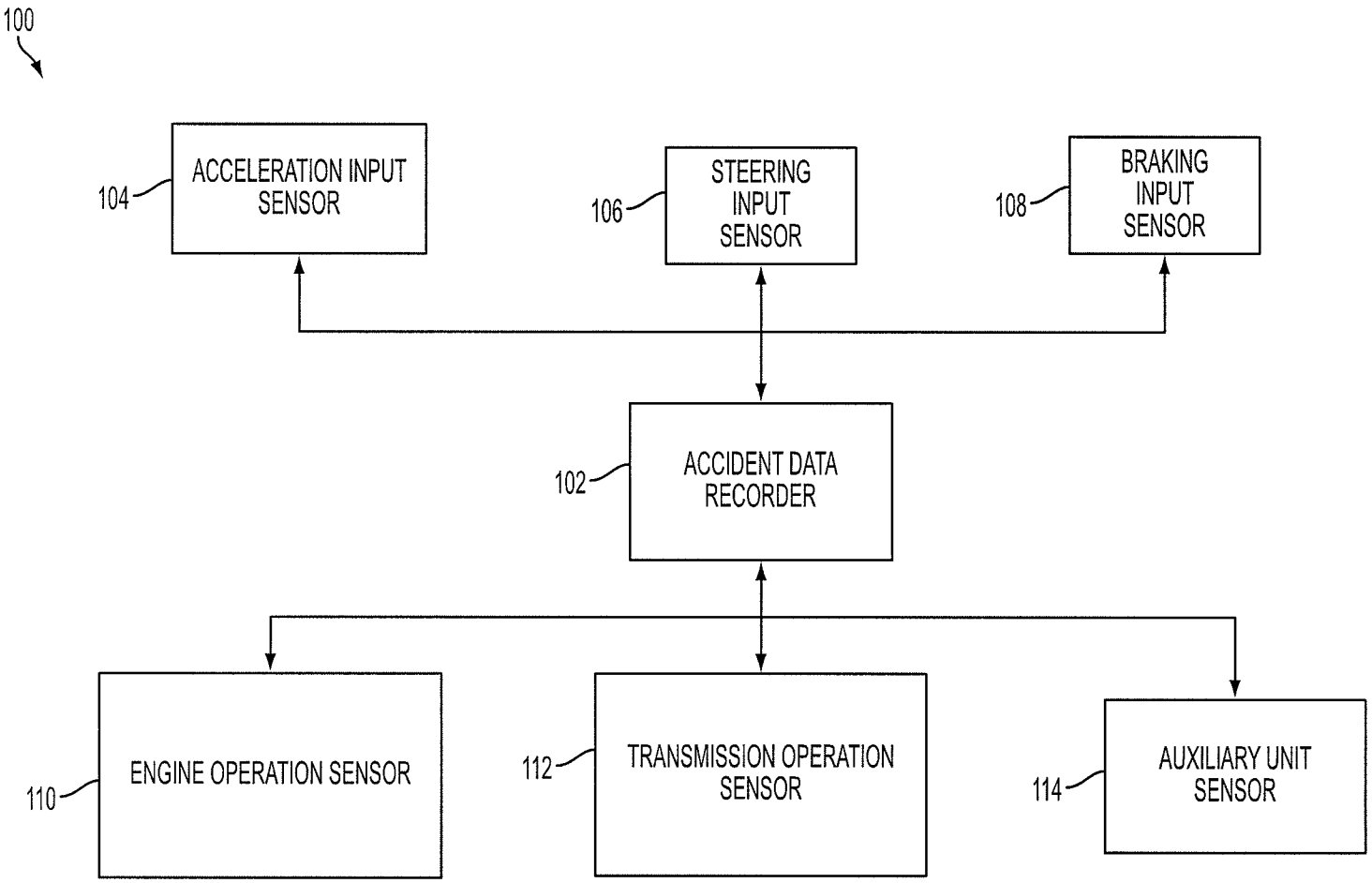
FIG. 1 shows a block diagram of components of an Accident Data Recorder (ADR) system according to an embodiment of the present invention.

FIG. 1 shows a block diagram of components of an ADR system 100 according to an embodiment of the present invention. The ADR system 100 may include an ADR 102 that collects data regarding operation of a vehicle in which the ADR 102 is incorporated. In an embodiment, the ADR 102 may record dynamic data for a period of time using various sensors and devices of the vehicle, and then once the accident occurs (for example, by recognizing that airbags are deployed), the ADR 102 may store the collected data of the last time period leading to the accident in a memory connected to or integrated in the ADR 102. In an embodiment, the ADR 102 may be activated by events that typically precede an accident (such as sudden changes in velocity) and may continue to record dynamic data until the accident is over, and/or until the recording time is expired. Various other time periods leading to the accident and various other accident data recording algorithms may be utilized to record prior vehicle operation data.

Referring to FIG. 1, the ADR 102 may be connected to an acceleration input sensor 104. The acceleration input sensor 104 may be, for example, an acceleration pedal sensor. The acceleration pedal sensor, for example, detects a depression percentage of the acceleration pedal. The ADR 102 may record the foregoing prior acceleration input data and other types of acceleration input data, which may be utilized to recreate the accident by applying the same acceleration input to a test vehicle.

Referring to FIG. 1, the ADR 102 may be connected to a steering input sensor 106. The steering input sensor 106 may be, for example, a steering wheel rotation sensor that detects a rotation of a steering wheel in the vehicle. The steering wheel rotation sensor can detect an amount of rotation of a steering wheel. For example, the steering wheel rotation sensor can detect that a steering wheel has been rotated by 20 degrees in a clockwise direction. The steering wheel rotation sensor can also determine an amount of time that has lapsed since the user has rotated the steering wheel in a particular direction. The ADR 102 may record the foregoing prior steering input data and other types of prior steering input data used, which may be utilized to recreate the accident by applying the same steering input to a test vehicle.

Referring to FIG. 1, the ADR 102 may be connected to a braking input sensor 108. The braking input sensor 108 may be, for example, a brake pedal sensor that detects a depression of a brake pedal in the vehicle. For example, the braking input sensor 108 can detect if the user completely depresses the brake pedal, partially depressed the brake pedal, or is not depressing the brake pedal at all. The brake pedal sensor can also detect how much the user has depressed the brake pedal, for example, in terms of percentage of depression. The brake pedal sensor can also detect an amount of time that has lapsed since the user has depressed the brake pedal. The ADR 102 may record the foregoing prior braking input data and other types of prior braking input data used for recreation of the accident, which may be utilized to recreate the accident by applying the same braking input to a test vehicle.

The ADR 102 may further be connected to an engine operation sensor 110. The engine operation sensor 110 is any sensor configured to detect a parameter related to an engine of the vehicle. For example, in an embodiment, the engine operation sensor 110 may include an engine output speed sensor. The ADR 102 may record the foregoing data and other types of data regarding engine operations. The operational conditions can include, for example, engine input speed, engine output speed, throttle opening, fuel/oxygen mixture, engine temperature, fuel consumption, engine failures, engine efficiency, an engine operation mode, and/or any other type of information related to the operation of the engine.

The ADR 102 may further be connected to a transmission operation sensor 112. The transmission operation sensor 112 may detect a parameter related to a transmission of the vehicle. The transmission may be a continuously variable transmission (CVT). For example, in an embodiment, the transmission operation sensor 112 may include a transmission input speed sensor. For example, the transmission operation sensor 112 can detect whether the transmission is operating in an alternate transmission control mode. The alternate transmission control mode can be, for example, a cruise control mode, a snow mode, and/or an electric power only mode. The ADR 102 may record the foregoing data and other types of data regarding transmission operations, for recreating an operation of the transmission of the crashed vehicle.

The ADR 102 may further be connected to an auxiliary unit sensor 114. For example, an operation of an auxiliary unit such as an HVAC (Heating, Ventilation, and Air Conditioning) unit may affect a load exerted on the engine of the vehicle. Data regarding devices that have an effect on engine load may be utilized to accurately recreate the engine operations and the engine load during the time period leading to the accident. In an embodiment, such data can be used to determine and recreate the vehicle power output of the crashed vehicle.

In an embodiment, data regarding any device or unit that exerts an electrical and/or engine load may be collected and stored in the ADR 102. For example, data may be collected regarding an operation or a current setting of a compressor, an alternator, power steering, an air pump, and/or various other accessories powered by the crankshaft and/or an electrical source of energy such as a battery of the vehicle. Data may also be collected regarding an energy generation unit of the vehicle to determine and recreate the power available for operating the crashed vehicle at the time of and/or before the accident.

In addition, any data regarding settings or conditions of other units or devices of the vehicle that may assist in understanding the causes of accident and/or a condition of the crashed vehicle at the time of and/or before the accident may be collected. For example, the ECU (Electronic Control Unit) of the vehicle may determine whether the headlights and/or the brake lights are on or off.

The ADR 102 may further be connected to sensors configured to detect the vehicle's speed and acceleration. The ADR 102 may further be connected to other powertrain sensors. The foregoing discussion with respect to FIG. 1 provides examples of prior vehicle operation data that may be analyzed and stored in the ADR 102. However, the prior vehicle operation data may be any other type of data regarding any operation of the vehicle that are helpful for accident recreation. The prior vehicle operation data may not be necessarily stored in a memory incorporated in the crashed vehicle. For example, the prior vehicle operation data may be stored via cloud technology. In an embodiment, the prior vehicle operation data may be communicated to and stored in a portable electronic device in communication with an ECU of the crashed vehicle and/or the ADR 102.

The foregoing discussion with respect to FIG. 1 relates to data collection and storage at the time of and/or before the crashed vehicle has the accident. Prior vehicle operation data may also be detected after the accident in the event that conditions of the test vehicle after the accident are indicative of causes of the accident. The following discussion with respect to FIG. 2 relates to analysis of prior vehicle operation data stored by the ADR 102, for example, after the accident occurs, in order to analyze and recreate an operation of the crashed vehicle. The recreation is performed by automatically operating a test vehicle having similar make, model and conditions of the crashed vehicle in substantially the same or identical manner as the test vehicle was operated, as determined by the prior vehicle operation data stored in the ADR 102.

Figure 2:
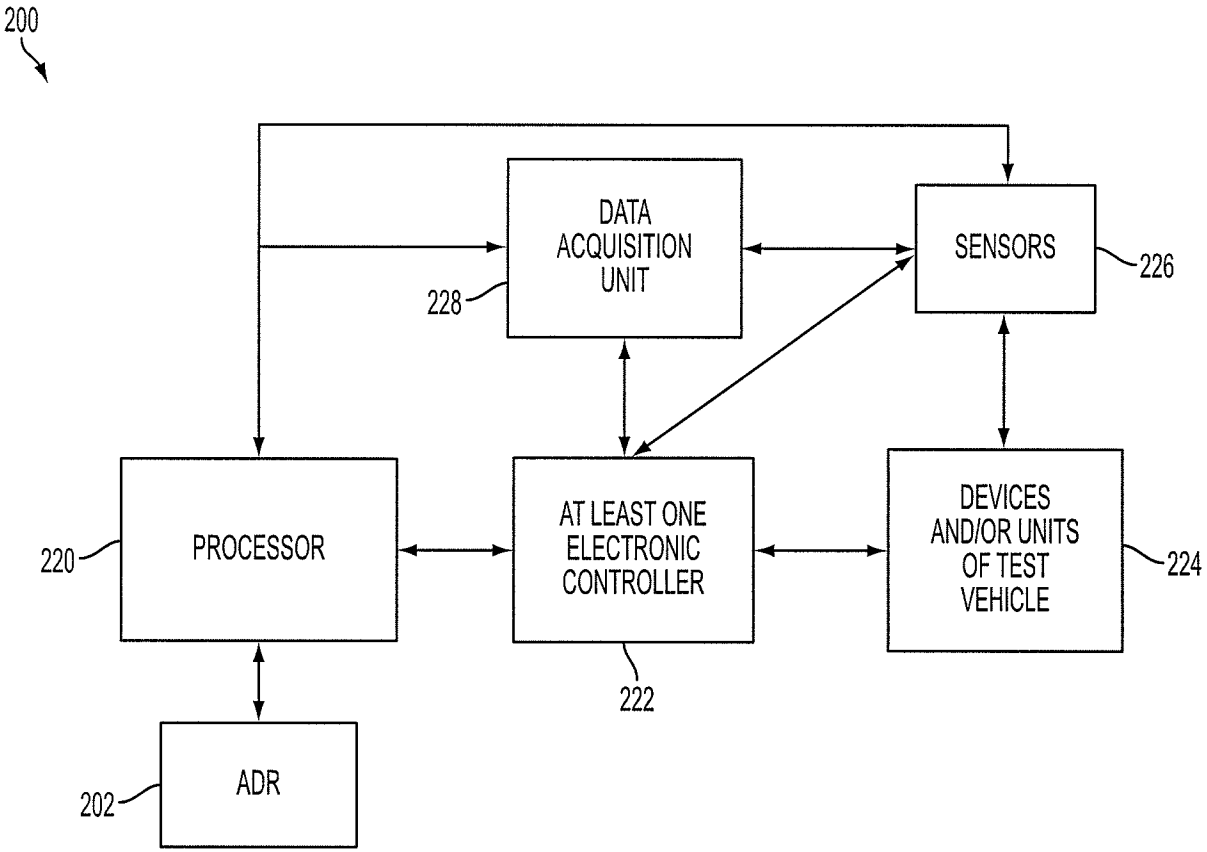
FIG. 2 shows an accident recreation system for recreating a prior operation of a crashed vehicle before and/or at the time of an accident according to an embodiment of the present invention.

FIG. 2 shows an accident recreation system 200 for recreating a prior operation of a crashed vehicle before and/or at the time of an accident. The accident recreation system 200 may include a processor 220 configured to retrieve and/or analyze data recorded in a memory of the ADR 202. In an embodiment, a memory connected to and/or integrated in the ADR 202 may store prior vehicle operation data, as discussed above with respect to the ADR 102 of FIG. 1. The prior vehicle operation data may correspond to the prior operation of a crashed vehicle before and/or at the time of the accident.

The processor 220 analyzes the prior vehicle operation data. For example, the processor 220 may perform a rationality check as discussed in more details with respect to the methods of FIGS. 5 and 6. The processor 220 may output vehicle control data or signal to the at least one electronic controller 222 based on the analyzed prior vehicle operation data. In addition to or instead of the rationality check, the processor 220 may perform other analysis and processing of data prior to outputting vehicle control data or signal. The at least one electronic controller 222 is configured to control a test operation of a test vehicle. The test vehicle may be similar in make and model to the crashed vehicle.

In an embodiment, the vehicle control data or signal control a test operation of a test vehicle such that the test operation mirrors an operation of the crashed vehicle before and/or at the time of the accident, as indicated by prior vehicle operation data. For example, the at least one electronic controller 222 may be an ECU of the test vehicle that controls the devices and/or units of the test vehicle 224 based on the vehicle control data or signal. The devices and/or units of the test vehicle 224 include any device or unit of the test vehicle that may be controlled to recreate an operation of a corresponding device and/or unit of the crashed vehicle. For example, the devices and/or units of test vehicle 224 may include devices and/or units discussed above with respect to FIG. 1, which include the engine, the transmission, the auxiliary devices, etc.

The test vehicle may also be configured to have the same properties as the crashed vehicle. For example, the tires of the test vehicle may be set to the same temperature of the tires of the crashed vehicle. Other test vehicle characteristics and environmental conditions may be chosen and/or modified to accurately recreate the operations of the crashed vehicle and its surrounding environment. In an embodiment, the test vehicle may be placed on a surface very similar to where the crash occurred. For example, if the test vehicle may be operated on a wet surface if the accident occurred on a rainy day. The test vehicle may be operated on, for example, a skid pad which is a test track that may be made of a flat area of asphalt. Other road surfaces or test driving surfaces may be utilized based on data known about the road surface of the accident.

As discussed above with respect to FIG. 1, in an embodiment, the prior vehicle operation data are not limited to driving data as they include, for example, whether and how an auxiliary device of the crashed vehicle was used. The at least one electronic controller 222 may control the corresponding auxiliary device of the test vehicle to operate in the same manner, and/or have the same settings. In an embodiment, any device and/or unit of the test vehicle may be controlled to be in the same condition of and/or operate in the same manner as the corresponding unit in the crashed vehicle, as indicated by the prior vehicle operation data, for example, as described above with respect to FIG. 1.

For example, the at least one electronic controller 222 may be connected to an auxiliary unit and/or a controller. For example, the at least one electronic controller 222 may set parameters and settings of the auxiliary unit and/or the controller such that the same amount of auxiliary load is exerted on the engine of the test vehicle and/or same amount of electrical energy is consumed, as compared with the auxiliary load exerted on the engine of the crashed vehicle and electrical energy consumed by the auxiliary load of the crashed vehicle, respectively.

For example, the engine of the test vehicle may be controlled to have the same operating conditions as the engine of the crashed vehicle with respect to the engine input speed, engine output speed, throttle opening, fuel/oxygen mixture, engine temperature, fuel consumption, engine failures, engine efficiency, engine operation mode, other conditions and operations, and/or combinations thereof.

For example, the transmission of the test vehicle may be controlled to have the same operating conditions as the transmission of the crashed vehicle with respect to the transmission input speed, transmission output speed, transmission ratio, transmission mode of operation, other conditions and operations, and/or combinations thereof.

For example, any unit or device of the test vehicle that exerts an electrical load and/or a load on the engine may be operated to exert the same electrical and/or engine load as exerted by the corresponding unit or device of the crashed vehicle, as indicated by the prior vehicle operation data. For example, the HVAC unit, compressor, alternator, power steering, air pump, or various other accessories powered by the crankshaft and/or an electrical source of energy such as a battery of the test vehicle may be operated as indicated by the prior vehicle operation data.

The powertrain of the test vehicle may also be operated similarly as the powertrain of the crashed vehicle. The test vehicle may be operated to have the same acceleration and velocity that the crashed vehicle had at the time of and/or before the accident.

With continued reference to FIG. 2, a data acquisition unit 228 may be utilized in the test vehicle for monitoring various operations of the test vehicle and/or recording data regarding the various operations, for example, using sensors 226. The data acquisition unit 228 may include and/or be connected to a processor and a memory for analyzing data detected by the sensors 226.

The sensors 226 may include a vehicle acceleration sensor for detecting an acceleration of the test vehicle during the test operation of the test vehicle. The sensors 226 may further include a vehicle velocity sensor for detecting a velocity of the test vehicle. The sensors 226 may include an engine sensor and/or a transmission sensor for detecting an engine operation and/or transmission operation of the engine and/or the transmission of the test vehicle, respectively. For example, the sensors 226 may detect an engine input speed, an engine output speed, a transmission input speed, a transmission output speed, a transmission ratio, and/or other characteristics of the engine and the transmission.

The sensors 226 may further be connected to an airbag controller to detect characteristics of airbag deployment during the test operation. The data acquisition unit 228 may further be connected to the at least one electronic controller 222 of the test vehicle for determining various other data regarding the vehicle's operation. In addition, data regarding the environment in and/or outside of the test vehicle may be collected.

In an embodiment, the data acquired by the data acquisition unit 228 may further be analyzed in substantially real time and/or at a later time for analyzing the accident recreation operation of the test vehicle. In an embodiment, the data acquired by the data acquisition unit 228 may be analyzed in substantially real time as a feedback mechanism for adjusting the control of the devices and/or units of test vehicle 224. For example, the vehicle control data outputted to the at least one electronic controller 222 may be modified based on the acquired data. The data acquisition unit 228 may include a processor for analyzing the acquired data. In addition or alternatively, another processor (e.g., the processor 220) may analyze data collected by the data acquisition unit 228, in real time or after the test operation.

Although recreation of the accident is performed after the accident, in an embodiment, the analysis of data collected by the ADR may be performed before and/or after the accident occurs. For example, data collected by the ADR 202 may be translated into rational values before the accident and/or after the accident.

Figure 3:
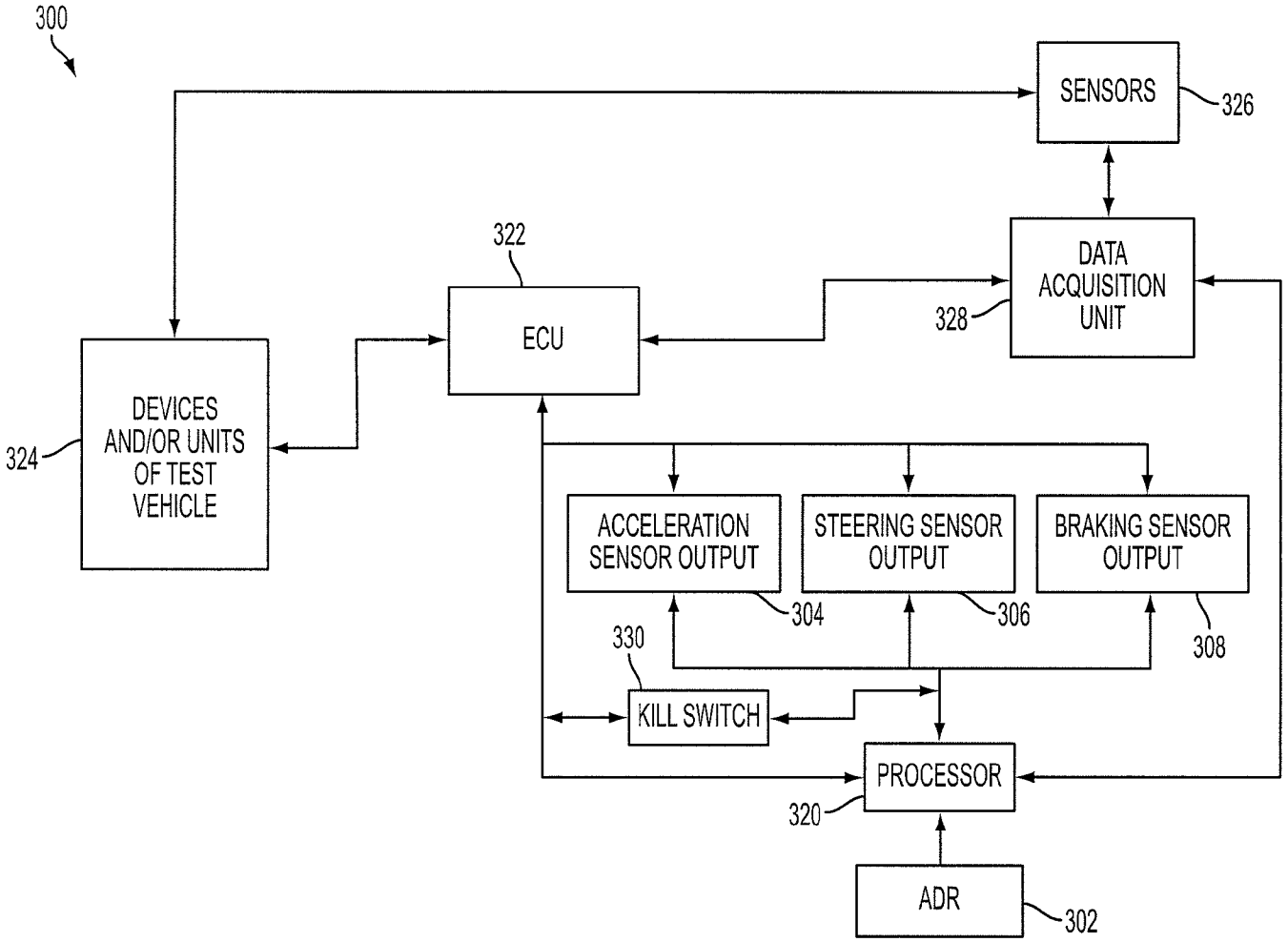
FIG. 3 shows an accident recreation system for recreating a prior operation of a crashed vehicle before and/or at the time of an accident, by establishing electrical connections with an electronic control unit (ECU) of a test vehicle, according to an embodiment of the present invention.

FIG. 3 shows an accident recreation system 300 for recreating a prior operation of a crashed vehicle before and/or at the time of an accident, by establishing electrical connections with an ECU 322 of a test vehicle, according to an embodiment of the present invention.

An ADR 302, a processor 320, an ECU 322, sensors 326, a data acquisition unit 328 may be utilized, for example, as discussed above with respect to the ADR 202, the processor 220, the at least one electronic controller 222, the sensors 226, the data acquisition unit 228, respectively.

In an embodiment, the at least one electronic controller 222 includes an ECU 322 integrated in the test vehicle. An electronic connection between the processor 320 and the ECU 322 may be established, for example, if the test vehicle incorporates a drive-by-wire (DbW) system. The DbW system, as used in this application, refers to any vehicle system that uses electrical and/or electromechanical systems for performing vehicle functions traditionally achieved by mechanical linkages and/or actuators. In an embodiment, when the test vehicle is a DbW system, the accident recreation system 300 provides the unique advantage of controlling the ECU 322 of the test vehicle without intrusive restructuring of the test vehicle and/or incorporating additional actuators.

In an embodiment, the processor 320 may be connected directly to the ECU 322 as shown in FIG. 3. The electrical connection may be made by connecting the processor 320 to a wiring harness of the test vehicle (for example, using wire attachment clips). In an embodiment, the processor 320 may be connected to a microcontroller (not shown) connected to the ECU 322. The microcontroller may be connected to the processor 320 using, for example, a communication cable or via wireless communication. Microcontroller may include an integrated circuit, processing unit, communication interface, and/or storage.

In an embodiment, the processor 320 outputs vehicle control data or signal directly or indirectly to the ECU 322. For example, the ECU 322 may normally operate using control signals in form of electronic signals (such as voltage signals), and the normal voltage signals may be replaced by electronic signals that are based on the vehicle control data or signal output by the processor 320. As a result, the ECU 322 may control the vehicle using the vehicle control data or signal, thereby recreating how the test vehicle operated at the time of and/or before the accident.

In an embodiment, in addition to or instead of connection of the processor 320 and the ECU 322 as described above, the processor 320 may be connected to a steering sensor output 306. In an embodiment, the steering sensor output 306 may be for example, the wiring harness and/or output wires of a steering input sensor of the test vehicle. The steering input sensor of the test vehicle may correspond to the steering input sensor 106 of the crashed vehicle, as set forth above with respect to FIG. 1. The processor 320 may output steering control data or signal to the steering sensor output 306. For example, a microcontroller and/or a digital to analog converter may be connected in between the processor 320 and the steering sensor output 306. In an embodiment, the steering sensor output 306 converts and/or relays the vehicle control data or signal to the ECU 322. For example, the output of the steering sensor output 306 to the ECU 322 may be in form of voltage signals that are normally sent to an ECU by a steering input sensor of the test vehicle.

By utilizing the steering sensor output 306, the ECU 322 controls steering of the test vehicle based on the steering control data or signal, as if the steering were manually operated to the same degree as indicated by prior vehicle operation data. In an embodiment in which the steering control data or signal are transmitted electronically directly to the ECU 322 and/or via the steering sensor output 306, a significantly improved control accuracy may be achieved because in such an embodiment, there may be no need for manual operation of the steering (which may be susceptible to inaccuracies). In other words, the test vehicle may be accurately operated without any driver.

A kill switch 330 may be connected to an electrical connection between the processor 320 and the ECU 322 as a safety mechanism. The kill switch 330 may also be connected to one or more electrical connections between the processor 320 and the acceleration sensor output 304, the steering sensor output 306, and/or the braking sensor output 308 as a safety mechanism. In an embodiment, if the kill switch 330 is switched to an on state, the corresponding vehicle control output or signals would be disconnected from the ECU 322, and the test vehicle can be driven as normally operated prior to being controlled using the vehicle control data or signal of the accident recreation system. In one embodiment, one or more kill switches 330 may be utilized to selectively disconnect a particular vehicle control output without affecting the other vehicle control outputs. For example, steering control data or signal may be cut without affecting braking control data or signal.

Other devices and/or units of the test vehicle may be controlled based on prior vehicle operation data. For example, the processor 320 may output acceleration control data or signal to the ECU 322, directly and/or via an acceleration sensor output 304. The acceleration sensor output 304 may include, for example, the wiring harness and/or output wires of an acceleration input sensor of the test vehicle. The acceleration input sensor of the test vehicle may correspond to or be similar to the acceleration input sensor 104 utilized in the crashed vehicle, as set forth above with respect to FIG. 1.

In an embodiment, the processor 320 may output braking control data or signal to the ECU 322, for example, directly and/or via a braking sensor output 308. For example, the braking sensor output 308 may include for example, the wiring harness and/or output wires of a braking input sensor 108 of the test vehicle. The braking input sensor of the test vehicle may correspond to or be similar to the braking input sensor 108 utilized in the crashed vehicle, as set forth above with respect to FIG. 1. For example, the braking of the test vehicle may be electromechanical, and the ECU 322 may operate actuators that control braking as if a driver were present and pressing the brake pedal to achieve the same effect.

The data acquisition unit 328 may record data regarding a test operation of the test vehicle, as the test vehicle is operated based on the applied acceleration control data or signal, steering control data or signal, and/or braking control data or signal. The test operation may be analyzed in real time and/or after the test operation, as discussed in more detailed below with respect to methods of FIGS. 5 and 6.

Figure 4:
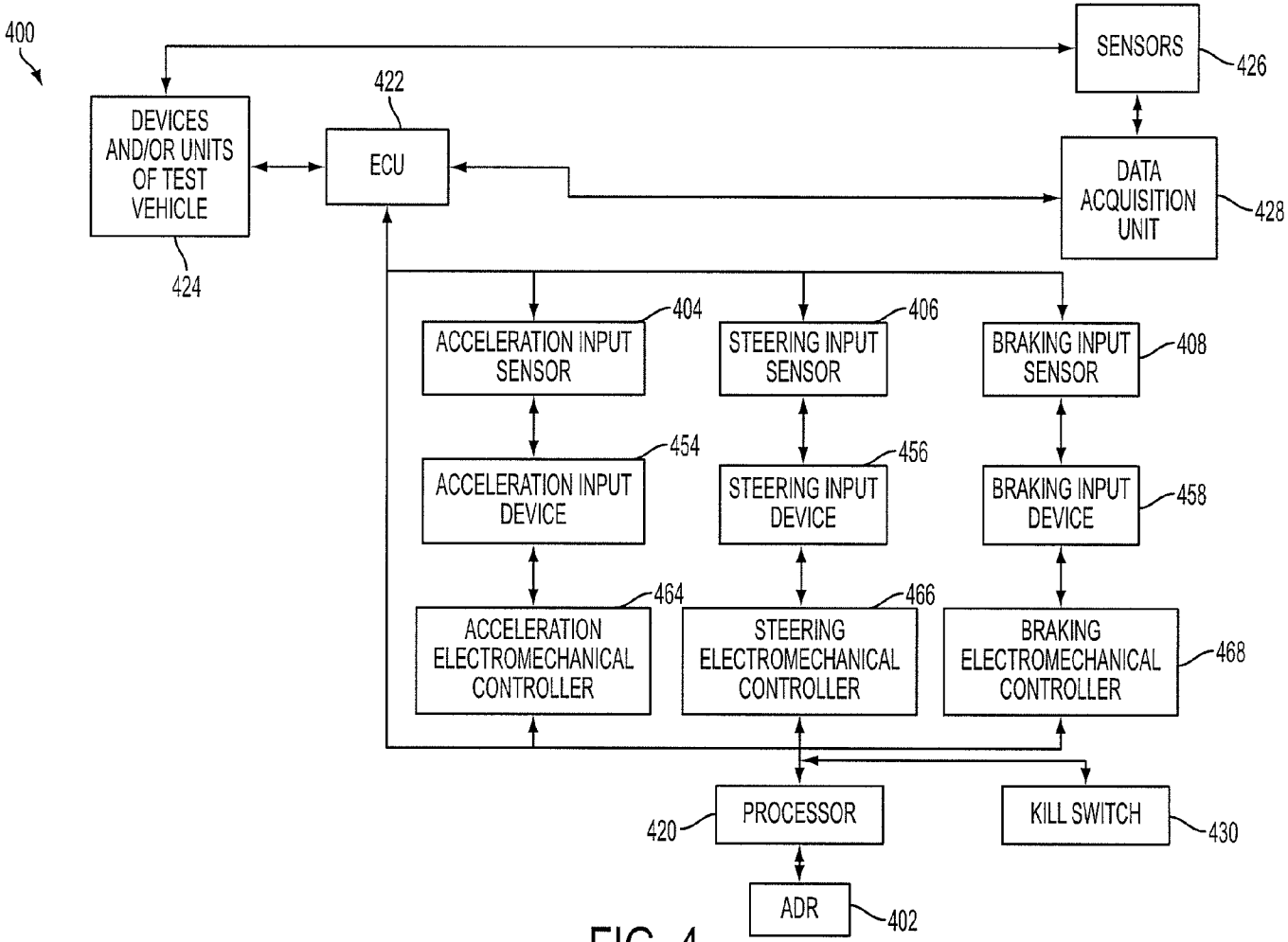
FIG. 4 shows an accident recreation system for recreating a prior operation of a crashed vehicle before and/or at the time of an accident, by incorporating electromechanical controllers for automatically operating a test vehicle, according to an embodiment of the present invention.

FIG. 4 shows an accident recreation system 400 for recreating a prior operation of a crashed vehicle before and/or at the time of an accident, by incorporating electromechanical controllers for automatically operating a test vehicle, according to an embodiment of the present invention. In an embodiment, if the test vehicle is not a DbW system or includes input devices (such as a braking input device) that may not be controlled using electrical connections (for example, as discussed above with respect to FIG. 3), additional electromechanical controllers such as actuators and/or robotic devices may be utilized for controlling input devices of the vehicle. In an embodiment, the test vehicle may partially operate using a DbW system and partially using electromechanical controllers (e.g., actuators). For example, some functions may be operated by electrical connections to the ECU 422, and some functions may be operated using the additionally incorporated electromechanical controllers.

The processor 420 may output acceleration control data or signal to an acceleration electromechanical controller 464. The acceleration electromechanical controller 464 may be, for example, an actuator and/or a robotic device that controls the acceleration input device 454 based on the acceleration control data or signal. For example, the acceleration input device 454 may be an acceleration pedal. The acceleration electromechanical controller 464 may depress the acceleration pedal to the same degree that the corresponding acceleration pedal of the crashed vehicle was depressed, as indicated by the prior vehicle operation data, in order to accurately recreate the response of the crashed vehicle to the acceleration input. In an embodiment, the acceleration input sensor 404 detects the input provided by the acceleration input device 454, and transmits a signal to the ECU 422. The ECU 422 may operate the test vehicle based on the signal received from acceleration input sensor 404.

The processor 420 may output steering control data or signal to a steering electromechanical controller 466. The steering electromechanical controller 466 may be, for example, an actuator and/or a robotic device that controls the steering input device 456 based on the steering control data or signal. For example, the steering input device 456 may be a steering wheel. The steering electromechanical controller 466 may turn and/or control the steering wheel to the same degree and direction that the corresponding steering wheel of the crashed vehicle was turned, as indicated by the prior steering input data, in order to accurately recreate the response of the crashed vehicle to the steering input. In an embodiment, the steering input sensor 406 detects the input provided by the steering input device 456, and transmits a signal to the ECU 422. The ECU 422 may operate the test vehicle based on the signal received from steering input sensor 406.

The processor 420 may output braking control data or signal to a braking electromechanical controller 468. The braking electromechanical controller 468 may be, for example, an actuator and/or a robotic device that controls the braking input device 458 based on the braking control data or signal. For example, the braking input device 458 may be a braking pedal. The braking electromechanical controller 468 may depress the braking pedal to the same degree that the corresponding braking pedal of the crashed vehicle was depressed, as indicated by the prior braking input data, in order to accurately recreate the response of the crashed vehicle to the braking input. In an embodiment, the braking input sensor 408 detects the input provided by the braking input device 458, and transmits a signal to the ECU 422. The ECU 422 may operate the test vehicle based on the signal received from braking input sensor 408.

The electromechanical controllers 464, 466, and/or 468 may be installed in the test vehicle. In an embodiment, the processor 420 may be placed in the test vehicle during the test operation. In an embodiment, the processor 420 may be placed outside of the test vehicle and communicate remotely with the electromechanical controllers 464, 466, and/or 468. In an embodiment, one or more of electromechanical controllers 464, 466, and/or 468 may be utilized in addition to other electromechanical controllers for automatically operating other devices and/or units of the test vehicle, to recreate operation of corresponding devices and/or units of the crashed vehicle.

Figure 5:
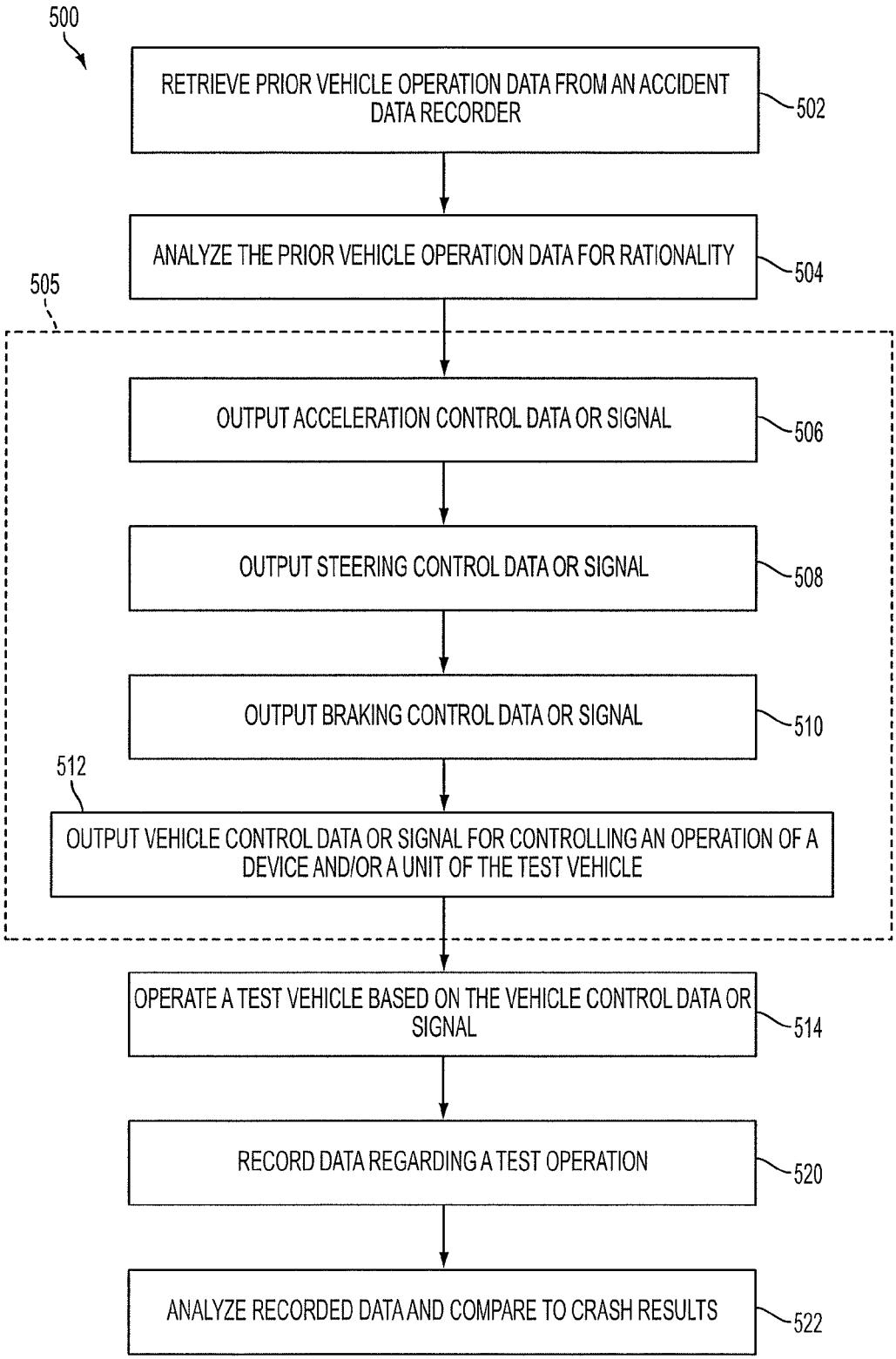
FIG. 5 is a flowchart diagram of a method for recreating a prior operation of a crashed vehicle before and/or at the time of an accident, according to an embodiment of the present invention.

FIG. 5 is a flowchart diagram of a method 500 for recreating a prior operation of a crashed vehicle before and/or at the time of an accident. In step 502, prior vehicle operation data of a crashed vehicle may be retrieved from a memory of an ADR (e.g., ADR 102, 202, 302, or 402). For example, the vehicle operation data may be retrieved using a processor (e.g., the processor 220, 320 or 420).

In step 504, the processor (e.g., the processor 220, 320 or 420) may analyze the prior vehicle operation data. For example, the processor may determine whether the prior vehicle operation data are rational. For example, if a particular parameter detected by a sensor and stored in the ADR is outside of a rational range, it can be determined whether the sensor itself malfunctioned, leading to inaccurate data. For example, an acceleration pedal depression percentage cannot be rationally outside the range of 0-100% at any given time. In an embodiment, irrational data will not be utilized for recreation of an operation of the test vehicle. Rationality may also be checked by analyzing relationships between two or more parameters. For example, if a vehicle speed is detected to be very high, and the steering wheel is detected to be rotated quickly at a high angle of rotation, it may be determined that the vehicle may not travel at such a high speed when turning sharply, therefore rendering the combination of the two parameters to be irrational.

Referring to block 505, the processor (e.g., the processor 220, 320 or 420) may output vehicle control data or signal based on the prior vehicle operation data. For example, the processor may convert prior vehicle operation data to control signals that would simulate the corresponding input and/or operation of the crashed vehicle, as discussed above with respect to FIGS. 2-4. The vehicle control data or signal may be outputted to the at least one electronic controller. The vehicle control data or signal outputted from the processor to the ECU 322 may be in digital and/or analog form. A digital-to-analog converter as known in the art may be utilized. The control signals outputted from the at least one controller may also be in digital and/or analog form. The processor may be positioned in the test vehicle or may communicate with the at least one electronic controller from a remote location outside of the test vehicle.

For example, in step 506, after determining that prior acceleration input data corresponds to acceleration inputs within a rational range, the prior acceleration input data may be converted to vehicle control data or signal for simulating the response of the crashed vehicle to the acceleration input of the crashed vehicle.

For example, in step 508, after determining that prior steering input data corresponds to steering inputs within a rational range, the prior steering input data may be converted to vehicle control data or signal for simulating the response of the crashed vehicle to the steering input of the crashed vehicle.

For example, in step 510, after determining that prior braking input data corresponds to braking inputs within a rational range, the prior braking input data may be converted to vehicle control data or signal for simulating the response of the crashed vehicle to the braking input of the crashed vehicle.

In step 512, after determining that prior vehicle operation data for a device and/or a unit of the vehicle (e.g., an auxiliary device or unit) corresponds to values within a rational range, the data may be converted to vehicle control data or signal for simulating the operation of the corresponding device and/or unit of the crashed vehicle.

In step 514, the at least one electronic controller may operate the test vehicle based on the vehicle control data or signal outputted in block 505. For example, the at least one electronic controller operates the test vehicle based on the same acceleration input applied at the time of and/or before the accident, as if the acceleration pedal was depressed by the same acceleration pedal depression percentage as indicated by the prior vehicle operation data. The at least one controller may be, for example, the at least one electronic controller 222, the ECU 322, or ECU 422. The simulation of acceleration input may be performed, for example, in a DbW test vehicle, a non-DbW test vehicle, or a test vehicle having a mixture of DbW and non-DbW components that are controlled for accident recreation, as discussed above with respect to FIGS. 3 and 4. The at least one electronic controller may operate the test vehicle based on the same steering input applied at the time of and/or before the accident, as if the steering wheel was turned with the same degree, direction, and timing as indicated by the prior vehicle operation data. The at least one electronic controller may further operate the test vehicle based on the same braking input applied at the time of and/or before the accident, as if the brake pedal were depressed to the same degree with the same timing as indicated by the prior vehicle operation data.

In an embodiment, the test vehicle may be operated similarly to the crashed vehicle but without crashing the test vehicle, if adequate inferences can be drawn regarding the causes of the accident without necessarily crashing the test vehicle. For example, in the event that a driver of the crashed vehicle claims that the crashed vehicle malfunctioned and did not stop when the driver depressed the brake pedal, to verify or reject the malfunctioning claim, it may be sufficient to operate the test vehicle using the braking, steering, and acceleration data without crashing the test vehicle. For example, the velocity and acceleration of the test vehicle operating in the same manner as the crashed vehicle before the accident may indicate whether there was a malfunctioning sufficient for causing an accident.

In step 520, data regarding operations of the test vehicle are recorded, for example, using data acquisition units discussed above with respect to FIGS. 2-4. Videos or images of the test vehicle during the test operation may be captured using cameras inside and/or outside of the test vehicle.

In step 522, data collected in the data acquisition unit (for example, data acquisition unit 228, 328, or 428) may be analyzed in real time. In an embodiment, post-test processing is performed. For example, detected electrical signals and voltages relating to tire pressure may be converted to physical or tangible physical values such as a tire pressure in PSI. In addition, the videos and/or images may be analyzed for determining a cause of the accident.

Figure 6:
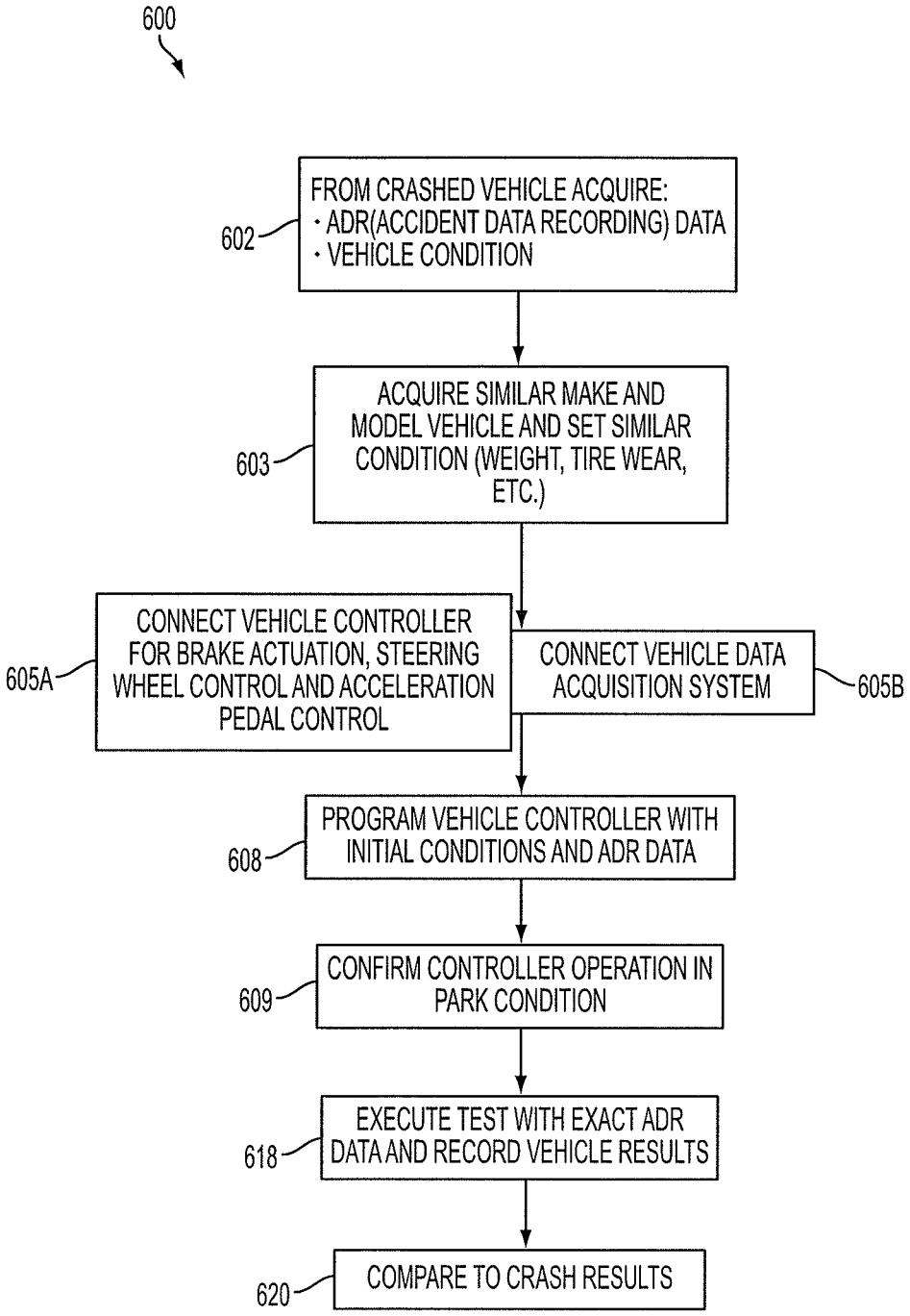
FIG. 6 is a flowchart diagram of a method for recreating a prior operation of a crashed vehicle before and/or at the time of an accident, according to an embodiment of the present invention.

FIG. 6 is a flowchart diagram of a method for recreating a prior operation of a crashed vehicle before and/or at the time of an accident. In step 602, the prior vehicle operation data or ADR data may be retrieved as discussed above with respect to step 502. Data regarding the crashed vehicle's condition may be obtained, for example, by physically examining the crashed vehicle. The examination may be helpful in rendering the test vehicle to be in the same condition.

In step 603, a test vehicle having a similar make and model to the crashed vehicle is acquired. In an embodiment, the test vehicle may be modified before the test operation and/or during the test operation to place the test vehicle in substantially the same condition as the crashed vehicle, as discussed above with respect to FIG. 2. For example, the weight of the test vehicle, tire wear of the test vehicle, and environmental conditions (such as road surface) may be adjusted to recreate the conditions of the crashed vehicle and its surrounding environment.

In step 605A, a vehicle controller may be connected for brake actuation, steering wheel control and acceleration pedal control. For example, in an embodiment, as shown in FIG. 4, the acceleration electromechanical controller 464, the steering electromechanical controller 466, and braking electromechanical controller 468 may be an acceleration input actuator, a steering input actuator, and a braking input actuator, for applying the same acceleration input, braking input, and steering input, respectively, as applied by the driver of the crashed vehicle at the time of or before the accident. In a DbW system, as discussed above with respect to FIG. 3, the controller may be a microcontroller that receives vehicle control data or signal from the processor 320 and outputs vehicle control data or signal to an ECU 322 already integrated in the test vehicle.

In step 605B, a data acquisition unit may be connected to the test vehicle, its sensors, and/or ECU, as discussed above with respect to FIGS. 2-4. In step 607, the controller, processor, and/or ECU may be programmed with initial conditions, prior vehicle operation data, and/or vehicle control data or signal to recreate the conditions and operations of the test vehicle.

As discussed above with respect to FIGS. 1-6, the accident recreation method and system advantageously provides the capability of precisely recreating the operation of the crashed vehicle during and/or before the accident. The test vehicle may be modified to be in the same condition as the crashed vehicle prior to the crash. Various units and devices of the test vehicle may be set to have the same characteristics and be in the same condition as the corresponding units and devices of the crashed vehicle prior to the accident for precisely recreating the operation of the crashed vehicle. Furthermore, the real-time in-vehicle dynamic simulation allows for a tangible examination of the crashed vehicle's operation at the time of and/or before the accident.

To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the disclosed apparatus and methods.

The various illustrative logical blocks, units, modules, and circuits described in connection with the examples disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the examples disclosed herein may be embodied directly in hardware, in a software module executed by a processor, or in a combination of the two. The steps of the method or algorithm may also be performed in an alternate order from those provided in the examples. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such that the processor can read information from, and write information to, the storage medium. In the alternative, the storage medium may be integral to the processor.

The previous description of the disclosed examples is provided to enable any person of ordinary skill in the art to make or use the disclosed methods and apparatus. Various modifications to these examples will be readily apparent to those skilled in the art, and the principles defined herein may be applied to other examples without departing from the spirit or scope of the disclosed method and apparatus. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed is:

1. A method for recreating a prior operation of a crashed vehicle before or at the time of an accident, comprising:

retrieving, from a memory of an accident data recorder, a prior vehicle operation data corresponding to the prior operation of the crashed vehicle before or at the time of the accident, the prior vehicle operation data including at least one of a prior steering input data or a prior braking input data;

analyzing, using a processor connected to the accident data recorder, the prior vehicle operation data;

providing at least one electronic controller configured to control a test operation of a test vehicle that is similar in make and model to the crashed vehicle;

outputting, using the processor, a vehicle control data or signal to the at least one electronic controller based on the analyzed prior vehicle operation data; and automatically operating, using the at least one electronic controller, the test vehicle based on the vehicle control data or signal in order to recreate the prior operation of the crashed vehicle in response to the at least one of the prior steering input data or the prior braking input data.

2. The method of claim 1, wherein the prior steering input data is detected by a steering input sensor of the crashed vehicle before or at the time of the accident, the vehicle control data or signal includes a steering control data or signal being based on the prior steering input data, and the step of operating, using the at least one electronic controller, the test vehicle based on the vehicle control data or signal automatically recreates a response of the crashed vehicle to the prior steering input data.

3. The method of claim 2, further comprising configuring the test vehicle with a steering electromechanical controller, wherein the step of automatically operating, using the at least one electronic controller, the test vehicle using the vehicle control data or signal includes controlling, using the steering electromechanical controller, a steering input device of the test vehicle for recreating a response of the crashed vehicle to the prior steering input data.

4. The method of claim 1, wherein the prior braking input data is detected by a braking input sensor of the crashed vehicle before or at the time of the accident, the vehicle control data or signal includes a braking control data or signal being based on the prior braking input data, and the step of automatically operating, using the at least one electronic controller, the test vehicle using the vehicle control data or signal automatically recreates a response of the crashed vehicle to the prior braking input data.

5. The method of claim 4, further comprising configuring the test vehicle with a braking electromechanical controller, wherein the step of automatically operating, using the at least one electronic controller, the test vehicle using the vehicle control data or signal includes controlling, using the braking electromechanical controller, a braking input device of the test vehicle for recreating a response of the crashed vehicle to the prior braking input data.

6. The method of claim 1, wherein the prior vehicle operation data includes a prior acceleration input data detected by an acceleration input sensor of the crashed vehicle before or at the time of the accident, the vehicle control data or signal includes an acceleration control data or signal being based on the prior acceleration input data, and the step of automatically operating, using the at least one electronic controller, the test vehicle using the vehicle control data or signal automatically recreates a response of the crashed vehicle to the prior acceleration input data.

7. The method of claim 6, further comprising configuring the test vehicle with an acceleration electromechanical controller, wherein the step of automatically operating, using the at least one electronic controller, the test vehicle using the vehicle control data or signal includes controlling, using the acceleration electromechanical controller, an acceleration input device of the test vehicle for recreating a response of the crashed vehicle to the prior acceleration input data.

8. The method of claim 1, wherein the step of automatically operating the test vehicle using the vehicle control data or signal includes automatically driving the test vehicle using the at least one electronic controller on a road surface or a test driving surface.

9. The method of claim 1, further comprising configuring the test vehicle to be in a similar condition as the crashed vehicle was before the time of the accident before perfoiining the step of automatically operating, using the at least one electronic controller, the test vehicle based on the vehicle control data or signal.

10. The method of claim 1, wherein the prior vehicle operation data includes data corresponding to at least a setting or an operation of a device or a unit of the crashed vehicle that exerts a load on an engine of the crashed vehicle, the method further comprising:

controlling, using the at least one electronic controller, a device or a unit of the test vehicle that corresponds to the device or the unit of the crashed vehicle such that a load exerted by the device or the unit of the test vehicle on an engine of the test vehicle automatically recreates the load exerted by the device or the unit of the crashed vehicle on the engine of the crashed vehicle.

11. The method of claim 1, wherein the at least one electronic controller includes an electronic control unit (ECU) integrated in the test vehicle, the method further comprising:

establishing at least one of:

an electronic connection between the processor and the ECU, or an electronic connection between the processor and a steering sensor output of the test vehicle; and outputting, using the processor, a steering control data or signal based on the prior steering input data, wherein the step of automatically operating, using the at least one electronic controller, the test vehicle using the vehicle control data or signal is performed automatically using the ECU and based on the outputted steering control data or signal.

12. The method of claim 1, wherein the at least one electronic controller includes an electronic control unit (ECU) integrated in the test vehicle, the method further comprising:

establishing at least one of:

an electronic connection between the processor and the ECU, or an electronic connection between the processor and a braking sensor output of the test vehicle; and outputting, using the processor, a braking control data or signal based on the prior braking input data, wherein the step of automatically operating, using the at least one electronic controller, the test vehicle using the vehicle control data or signal is performed automatically using the ECU and based on the outputted braking control data or signal.

13. The method of claim 1, further comprising:

detecting, using a plurality of sensors of the test vehicle, data regarding an operation of a unit or a device of the test vehicle; and analyzing a test operation of the test vehicle based on the detected data regarding the operation of the unit or the device of the test vehicle.

14. A method for recreating a prior operation of a crashed vehicle before or at the time of an accident, comprising:

retrieving, from a memory of an accident data recorder, a prior vehicle operation data corresponding to the prior operation of the crashed vehicle before or at the time of the accident, the prior vehicle operation data including:

a prior acceleration input data detected by an acceleration input sensor before or at the time of the accident, a prior steering input data detected by a steering input sensor before or at the time of the accident, and a prior braking input data detected by a braking input sensor before or at the time of the accident;

analyzing, using a processor connected to the accident data recorder, the prior steering input data, the prior braking input data, and the prior acceleration input data;

providing at least one electronic controller configured to control a test operation of a test vehicle that is similar in make and model to the crashed vehicle;

outputting, using the processor, a vehicle control data or signal to the at least one electronic controller based on the analyzed prior vehicle operation data, the vehicle control data or signal including:

an acceleration control data or signal being based on the prior acceleration input data, a steering control data or signal being based on the prior steering input data, and a braking control data or signal being based on the prior braking input data; and automatically operating, using the at least one electronic controller, the test vehicle based on the vehicle control data or signal in order to recreate the prior operation of the crashed vehicle or a response of the crashed vehicle to the prior acceleration input data, the prior steering input data, and the prior braking input data.

15. The method of claim 14, further comprising:

configuring the test vehicle with an acceleration electromechanical controller, a steering electromechanical controller, and a braking electromechanical controller, wherein the step of automatically operating, using the at least one electronic controller, the test vehicle based on the vehicle control data or signal includes:

controlling, using the acceleration electromechanical controller, an acceleration input device of the test vehicle for recreating a response of the crashed vehicle to the prior acceleration input data, controlling, using the steering electromechanical controller, a steering input device of the test vehicle for recreating a response of the crashed vehicle to the prior steering input data, and controlling, using the braking electromechanical controller, a braking input device of the test vehicle for recreating a response of the crashed vehicle to the prior braking input data.

16. The method of claim 14, wherein the at least one electronic controller includes an electronic control unit (ECU) integrated in the test vehicle, the method further comprising:

establishing an electronic connection between the processor and an acceleration sensor output of the test vehicle;

establishing an electronic connection between the processor and a steering sensor output of the test vehicle;

establishing an electronic connection between the processor and a braking sensor output of the test vehicle;

outputting, using the processor, an acceleration control data or signal based on the prior acceleration input data;

outputting, using the processor, a steering control data or signal based on the prior steering input data; and outputting, using the processor, a braking control data or signal based on the prior braking input data, wherein the step of automatically operating, using the at least one electronic controller, the test vehicle based on the vehicle control data or signal is performed automatically using the ECU and is based on the acceleration control data or signal, the steering control data or signal, and the braking control data or signal.

17. A system for recreating a prior operation of a crashed vehicle before or at the time of an accident, comprising:

an accident data recorder having a memory for storing a prior vehicle operation data corresponding to the prior operation of the crashed vehicle before or at the time of the accident, the prior vehicle operation data including at least one of a prior steering input data or a prior braking input data;

a processor connected to the accident data recorder and configured to:

retrieve the prior vehicle operation data, analyze the prior vehicle operation data, and output a vehicle control data or signal based on the analyzed prior vehicle operation data; and at least one electronic controller configured to:

receive the vehicle control data or signal, and operate a test vehicle based on the vehicle control data or signal in order to recreate the prior operation of the crashed vehicle in response to the at least one of the prior steering input data or the prior braking input data.

18. The system of claim 17, wherein the prior steering input data is detected by a steering input sensor of the crashed vehicle before or at the time of the accident, and the prior braking input data is detected by a braking input sensor of the crashed vehicle before or at the time of the accident, the vehicle control data or signal includes a steering control data or signal being based on the prior steering input data and includes a braking control data or signal being based on the prior braking input data, and the at least one electronic controller is further configured to recreate a response of the crashed vehicle to the prior steering input data and the prior braking input data.

19. The system of claim 18, wherein the prior vehicle operation data includes a prior acceleration input data detected by an acceleration input sensor of the crashed vehicle before or at the time of the accident, the vehicle control data or signal includes an acceleration control data or signal being based on the prior acceleration input data, and the at least one electronic controller is further configured to recreate a response of the crashed vehicle to the prior acceleration input data.

20. The system of claim 17, wherein the at least one electronic controller includes an electronic control unit (ECU) integrated in the test vehicle, the processor is connected to a steering sensor output of the test vehicle and a braking sensor output of the test vehicle, the processor is further configured to output a steering control data or signal based on the prior steering input data, and output a braking control data or signal based on the prior braking input data, and the ECU is further configured to automatically operate the test vehicle based on the steering control data or signal and the braking control data or signal for recreating a response of the crashed vehicle to the prior steering input data and the prior braking input data, respectively.

* * * * *